United States Patent [19]

Deforeit

[11] Patent Number: 4,484,180

[45] Date of Patent: Nov. 20, 1984

[54] SWITCH CONDITION INDICATOR

[75] Inventor: Christian J. Deforeit, Trossingen, Fed. Rep. of Germany

[73] Assignee: Matth. Hohner AG, Trossingen, Fed. Rep. of Germany

[21] Appl. No.: 372,309

[22] Filed: Apr. 27, 1982

[30] Foreign Application Priority Data

Apr. 29, 1981 [DE] Fed. Rep. of Germany ..... 3116941

[51] Int. Cl.[3] ..... G08C 9/00

[52] U.S. Cl. ..... 340/365 S; 340/365 R; 340/815.23; 340/644; 200/308; 84/169; 84/464 R

[58] Field of Search ..... 340/365 S, 365 C, 365 R, 340/365 A, 815.01, 815.03, 815.1, 815.11, 815.23, 641, 644; 200/308, 310, 312, 313, 317; 364/709, 710, 708, 713; 84/1.07, 169, 171, 172, 464 R, 464 A, 1.08, DIG. 7

[56] References Cited

U.S. PATENT DOCUMENTS 4,051,471 9/1977 Hatano et al. ..... 340/365 R 4,092,640 5/1978 Satoh ..... 200/310

*Primary Examiner*—Donnie L. Crosland

[57] ABSTRACT

The identification of the last-actuated of a plurality of parallel connected switches is provided by energizing a light source associated with the last-actuated switch and by providing a coded output signal which identifies the switch. The identification of a closed switch is accomplished through the use of logic circuitry which periodically imposes a potential difference across all of the switch associated light sources. The potential difference is sensed via the closed switch and functions as an initiation signal which causes generation of a coded output signal and maintains energization of the light source.

6 Claims, 2 Drawing Figures

SWITCH CONDITION INDICATOR

BACKGROUND OF THE INVENTION (1) Field of the Invention

The present invention relates to the identification of a single closed switch in a switch array and particularly to the provision of both visual and coded electrical indicia commensurate with such a closed switch. More specifically, this invention is directed to logic circuitry which may be associated with plural, parallel connected switches for providing a coded signal which identifies a closed switch while simultaneously causing energization of a light emitter associated with the closed switch. Accordingly, the general objects of the present invention are to provide novel and improved methods and apparatus of such character.

(2) Description of the Prior Art

The present invention is particularly useful with circuits known in the art as "tip switch banks". A "tip switch bank" comprises a plurality of switches wherein actuation of the switch contacts, i.e., making or braking, results from touching or "tipping" only. The switches comprising the "bank" may, for example, be momentary contact type switches or some other type of touch sensitive switch. The switches forming the "bank" may be functionally interrelated such that only the last switch "tipped" by the user is "valid" or enabled while all other, i.e., formerly actuated, switches are rendered "invalid" (disabled or cancelled). In this case, the switches of a "tip switch bank" are electrically mutually latched and only a single switch will at any one time be in the "actuated" state. In any case, however, each switch of the "bank" is provided with a light emitter, for example an indicator lamp, which will visually signal the state of its associated switch. In the typical case, the light emitter associated with the last switch of the "bank" to have been actuated will be energized.

"Tip switch banks" of the type briefly described above are frequently employed in electronic organs as the user input which determines the sound coloration when conventional musical instruments of different nature are to be simulated. Thus, a signal which identifies the last actuated switch will be employed to address a controlled circuit such as a filter, memory or the like to cause production of the audible output commensurate with the actuated switch.

In prior art "tip switch bank" control circuits the indicator lamp associated with each switch is allocated to one of the parallel outputs of a shift register. Binary data was serially shifted through the register under supervision of a control unit. The contents of the shift register were "permanently" available at the parallel outputs thereof in the form of "high" and "low", i.e., binary, voltage levels. The light emitting indicators were all also connected to a common bus which had applied thereto either the binary "high" or "low" voltage level. Thus, if the "high" or binary "1" voltage level is applied to the bus, an output of the shift register which has a binary 0 appearing thereon will result in the light emitter connected to that output being energized since there will be a sufficient potential difference across the light emitter to cause current to flow therethrough. With no switch actuated, all of the parallel data outputs of the shift register will be "high" and thus current will not flow through the light emitters associated therewith. The state of the output of the shift register will be read out as address information for a controlled or circuits such as filters, memories or the like.

Thus, in accordance with the prior art, upon actuation of one of the "tip switches" a control unit will load the shift register with binary data corresponding to the actuated switch. If another switch is "tipped", this fact must be signalled back to the control unit so that it may update the loading of the shift register. This signaling has previously been accomplished by individually connecting each switch to the control unit. Alternatively, all of the switches of the "bank" were scanned by means of a separate multiplexer. In either case the resulting circuitry is comparatively complex, particularly when the "bank" comprises a large number of switches.

SUMMARY OF THE INVENTION

The present invention comprises novel and improved circuitry for identifying and providing an indication of the state of actuation of the individual switches of an array of switches, particularly a "tip switch bank". A circuit in accordance with the present invention comprises a shift register and a control unit. The parallel data outputs of the shift register are individually connected to first terminals of the switches of the bank and to first terminals of the light emitting devices associated with the respective switches. The control unit causes the sequential loading of the shift register so as to transfer its contents to an output channel whereby the scanning of the switches is accomplished with a minimum of components, particularly wired connections.

In accordance with the present invention a first terminal of each of the switches is directly connected to one of the parallel data outputs of a shift register and to a first terminal of an associated light emitter. The second output terminal of all of the switches are connected to a common signaling bus to which a binary voltage level will be applied. The second terminals of each of the lamps are connected to a power bus to which a first binary voltage level is constantly applied. The signal bus serves as the input to a control unit which, via the shift register, periodically applies the second of the binary voltage levels to the switch first terminals. If one of the switches is closed when the said second binary voltage level is applied to its first terminal an input signal will be delivered to the control unit. This input signal will cause the application of bits at the first binary level to the serial data input of the shift register. The reappearance of the said first binary level at the shift register output corresponding to the closed switch will identify that switch. Upon identification of the actuated switch a "word" will be clocked into the shift register which will maintain a potential commensurate with the difference between the binary levels across the light emitter associated with the last closed switch whereby the light emitter will be energized.

In apparatus in accordance with the present invention only four, and in some cases only three, connections are needed between the control unit and the switch "bank" and its associated shift register. This is a significant reduction in circuit complexity when compared to the prior art.

BRIEF DESCRIPTION OF THE DRAWING

The present invention may be better understood and its numerous objects and advantages will become apparent to those skilled in the art by reference to the accompanying drawing wherein like reference numerals refer to like elements in the two figures and in which.

DESCRIPTION OF THE DISCLOSED EMBODIMENTS

Figure 1:
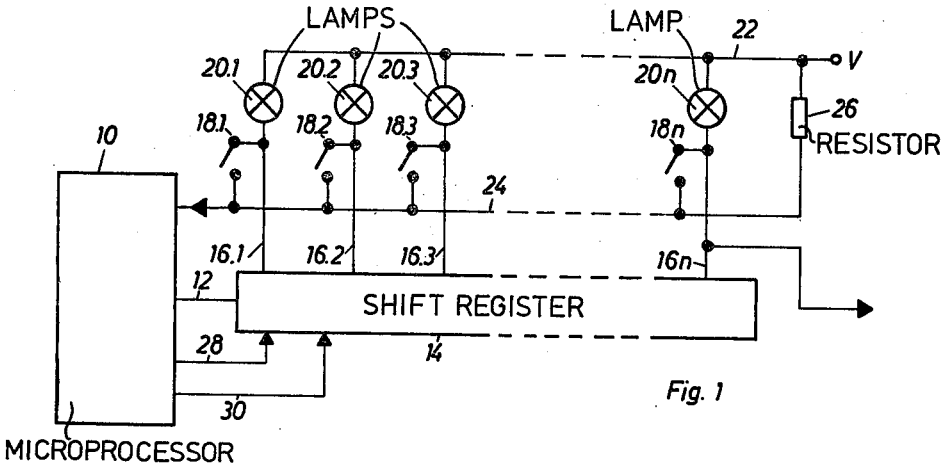
FIG. 1 is a schematic diagram of a first embodiment of the present invention.

With reference to FIG. 1, the present invention comprises a control unit 10 which is preferably a micro processor, e.g. type INTEL 8048, a shift register 14, a parallel array of "tip" switches 18 and a plurality of lamps or other light emitters 20. Control unit 10 applies serial input data via conductor 12 to shift register 14. After the shift register has been clocked through a first time, its parallel data outputs 16.1, 16.2, - - - 16*n* will carry the binary data inputted by control unit 10. Presuming that one of the switches 18 has been actuated, and in the manner to be described in greater detail below, a level 0 will appear on the parallel data output 16 of shift register 14 corresponding to that last-actuated switch 18. The parallel data outputs 16 of shift register 14 are each connected to a first terminal of a switches 18 and to a first terminal of the lamp 20 which are associated with that the switches. The lamps are preferrably housed in the switch keys. The second terminals of all of lamps 20 are connected to a common power bus 22 which carries the high potential level "V", i.e., the binary voltage level corresponding to a "1". Thus, in the steady state condition being explained, the lamp 20 connected to the last-actuated switch 18 will have a potential difference thereacross whereby current will flow through the lamp and it will provide a visually perceivable output.

The switches 18 will be devices of the type which, when their actuators are touched by a user, will close a circuit between the switch terminals. As noted above, one of the terminals of each of the switches is connected to a respective one of the parallel data outputs 16 of shift register 14. The second terminals of all of the switches 18 are connected to a signal bus 24, the switch terminals being briefly interconnected upon the switch being "tipped". Signal bus 24 is connected, via a resistor 26, to the power bus 22. Accordingly, when all of the switches 18 are in the open state, i.e., in the time periods between "tipping" of the switches, a binary "1" will appear on signal bus 24. As will also be described in more detail below, upon the "tipping" of one of switches 18, the binary level 0 will be momentarily applied to signal bus 24.

In order to determine whether one of the switches 18 has been "tipped", and to identify the last "tipped" switch, the control unit 10 periodically applies an erase signal via conductor 28 to shift register 14. Upon application of the erase command, all of the parallel data outputs 16 of shift register 14 will be switched to the 0 level. If one of the switches 18 is closed at the time the contents of shift register 14 are erased, the level 0 will be applied via that closed switch to signal bus 24 and thus will appear at the control input to the control unit 10. The appearance of a 0 level on the signal bus input to control unit 10 will result in the control unit shifting "high" level bits, i.e., "1's", through the shift register at a rate commensurate with the frequency of the clock input 30 to shift register 14. Such high or V-level shifting will continue until a "1" appears on the data output 16 corresponding to the last-actuated switch. Since the switch will, at this time, still be in the closed state, the "1" level is applied to signal bus 24, i.e., the "0" input level will be removed from the input to control unit 10. The number of high level bits generated since start of the shift cycle by the control unit will identify the position of the last-actuated switch 18 in the serial sequence at the shift register output, the shifting of "1's" through the shift register being terminated upon reapplication of the high or "1" binary level to signal bus 24.

In order to keep the lamp associated with all depressed and not mutually latched switches in the energized state, upon reappearance of the high binary level on signal bus 24, control unit 10 will store the identity of the last-actuated switch and will load a "word" commensurate with this identity into shift register 14 such that all of the parallel data outputs will be at the "1" level with the exception of the output corresponding to the depressed, non-latched switches which will be at the "0" level.

In the mode of operation described above, the signal for testing the status of the switches 18 is applied to the erase line 28. As an alternative, the control unit 10 may, during one shift cycle, deliver "0's" to the serial data input 12 until the low binary level is applied to the signal bus 24 via the last-actuated switch. While this alternative design reduces the number of connections between control unit 10 and the remainder of the circuitry from four to three, the control unit becomes somewhat more complex because of the increased amount of data to be processed.

Figure 2:
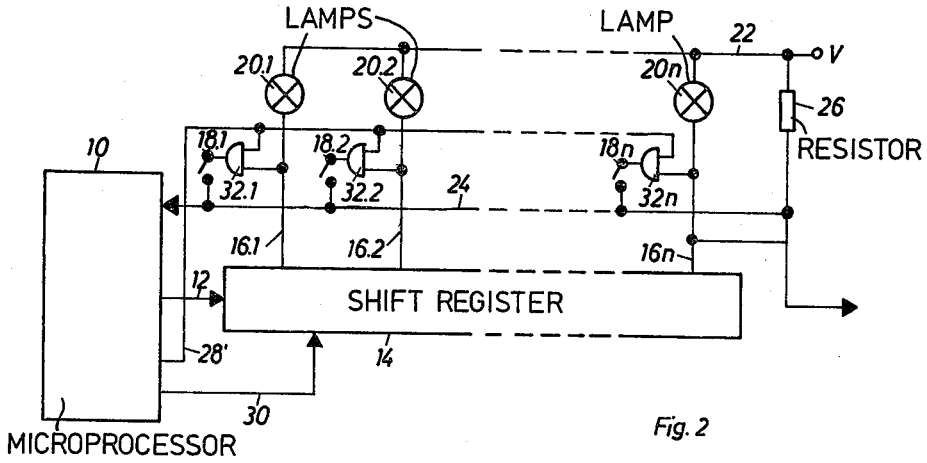
FIG. 2 is a schematic diagram of a second embodiment of the present invention.

In the embodiment described above, upon each test or scan of the switch "bank", the contents of the shift register 14 will be erased and reestablished. This may not be desirable under circumstances where the switches 18 are only occasionally actuated. Under these circumstances the embodiment depicted in FIG. 2 may be employed. In the FIG. 2 embodiment an AND gate 32 is associated with each of the switches 18. The gates 32 are all enabled by the erase output 28' of control unit 10. The FIG. 2 embodiment reduces the quantity of data which must be handled by control unit 10 by permitting the contents of shift register 14 to remain initially unerased during the testing cycle.

To summarize the above, the circuit of the present invention operates in two distinctly different modes. Firstly, to detect an actuated switch, all of the data outputs 16 of the shift register are simultaneously set to zero by an "erase" command and thus all of the lamps 20 will be momentarily energized. However, this period of energization is so short that the lamps either will not light or the period of illumination will be so short as to be imperceptible to the human eye. Signal bus 24 will be at the binary level "1", the voltage being applied to bus 24 via resistor 26, and will remain at this level if none of switches 18 has been actuated. Upon actuation of a switch 18, bus 24 will be connected to the corresponding data output 16 of shift register 14 and signal bus 24 will thus be pulled down to level "0". The switch which has been actuated is identified by shifting one's into shift register 14, as explained above, until bus 24 returns to the "1" level. Secondly, to illuminate a lamp 20 commensurate with an actuated switch, the number of that switch is clocked into register 14 whereby a "0" input level is applied to one terminal of the lamp to be illuminated via the shift register data output 16.

It will be understood that the number of switches 18 which may be employed in the practice of the present invention is not limited to three or four, as depicted in the drawing, and that the shift register 14, e.g. type F4164 standard TTL, is of a type which is commercially available. It will further be understood that if there are more switches 18 than the number of parallel data outputs of the shift register it is possible to add additional shift registers.

Employing the present invention in the environment of an electronic organ, the "test" pulse on the erasing line 28 from the control unit 10 need be generated only every 100 ms.

If a plurality of the switches 18 are accidentally simultaneously actuated, the one which is last in the shift sequence will be identified as the "valid" switch.

It is to be noted that the "test", "scan" or "inquiry" pulse will briefly apply a potential difference across all of the light emitters 20. However, the duty cycle is too small to cause the lamp or other light emitter to produce a visual output in response to the testing.

A further advantage of the present invention resides in the fact that it does not require the use of circuitry, for example flip-flop circuits, to suppress contact bounce in the case where the switches 18 comprises mechanical switches.

Referring again to the FIG. 2 embodiment, it is to be noted that it is possible to employ "tri-state" shift registers, e.g. 74LS374 standard TTL, which include the AND gates 32 thus enabling the more simplified wiring of FIG. 1 to be employed with the circuit of FIG. 2.

While preferred embodiments have been shown and described, various modifications and substitutions may be made thereto without departing from the spirit and scope of the invention. Accordingly, it is to be understood that the present invention has been described by way of illustration and not limitation.

What is claimed:

1. Apparatus for identifying which of a plurality of switches was last actuated, the switches each having a pair of contacts and being electrically connected in parallel, each of the switches having a light emitter associated therewith, said light emitters each having a pair of terminals, said apparatus comprising:

shift register means, said shift register means having a serial data input terminal and parallel data output terminals, said shift register means further having an erase input and a clock input;

means connecting individual of said shift register means data output terminals to a first contact of a respective switch and to a first terminal of the light emitter associated with the switch;

a power bus, said power bus being connected to second terminals of all of the light emitters;

a signal bus, said signal bus being connected to second contacts of all of the switches;

means for applying a voltage level commensurate with a first number to said signal bus; and control means, said control means periodically causing application of a voltage level commensurate with a second number to all of said means for connecting said shift register means data output terminals to said first switch contacts, said control means having a control input connected to said signal bus, said control means further having a data output connected to shift register means serial data input terminal, the application of said second voltage level to said signal bus via an actuated switch causing said control means to apply pulses at said first voltage level to said shift register means serial data input until said first voltage level is re-applied to said signal bus via the actuated switch, the number of applied pulses identifying the actuated switch.

2. The apparatus of claim 1 wherein said control means is connected to said shift register means erase input and the periodic delivery of an erase command to said shift register means causes said second voltage level to be applied to all of said shift register means parallel data output terminals.

3. The apparatus of claim 1 wherein said means connecting individual of said shift register means data output terminals to a first contact of respective switches comprises logic gates and wherein said control means periodically applies an enabling signal at the second voltage level to all of said gates.

4. The apparatus of claim 1 wherein said control means applies said pulses at said first voltage level to said shift register means serial data input during predetermined shift sequences.

5. The apparatus of claim 2 wherein said control means applies said pulses at said first voltage level to said shift register means serial data input during predetermined shift sequences.

6. The apparatus of claim 3 wherein said control means applies said pulses at said first voltage level to said shift register means serial data input during predetermined shift sequences.

* * * * *